US006476562B1

(12) United States Patent
Yoo et al.

(10) Patent No.: US 6,476,562 B1
(45) **Date of Patent: *Nov. 5, 2002**

(54) PLASMA DISPLAY PANEL USING RADIO FREQUENCY AND METHOD AND APPARATUS FOR DRIVING THE SAME

(75) Inventors: Yeun Ho Yoo, Kyunggi-do (KR); Jun Yeong Yoo, Seoul (KR); Jung Won Kang, Seoul (KR); Jeong Pil Choi, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/361,569

(22) Filed: Jul. 27, 1999

(30) Foreign Application Priority Data

| | | |
|---|---|---|
| Jul. 29, 1998 | (KR) | P98-30743 |
| Nov. 14, 1998 | (KR) | P98-48955 |
| Nov. 14, 1998 | (KR) | P98-48960 |
| Nov. 18, 1998 | (KR) | P98-49570 |
| Mar. 11, 1999 | (KR) | P99-8057 |

(51) Int. Cl.[7] ..... G09G 3/10

(52) U.S. Cl. ..... 315/169.2; 315/169.3; 313/582; 345/60

(58) Field of Search ..... 315/169.1, 169.2, 315/169.4, 167; 313/484, 582, 585, 586; 345/60, 61, 66, 76

(56) References Cited

U.S. PATENT DOCUMENTS

| | | | | |
|---|---|---|---|---|
| 5,446,344 A | | 8/1995 | Kanazawa | 315/169.4 |
| 5,739,641 A | * | 4/1998 | Nakamura et al. | 315/169.1 |
| 5,828,353 A | * | 10/1998 | Kishi et al. | 345/55 |
| 6,255,777 B1 | * | 7/2001 | Kim et al. | 313/582 |
| 6,271,810 B1 | * | 8/2001 | Yoo et al. | 315/169.4 |
| 6,317,105 B1 | * | 11/2001 | Eo et al. | 345/68 |
| 6,340,866 B1 | * | 1/2002 | Yoo | 315/169.3 |

FOREIGN PATENT DOCUMENTS

| | | |
|---|---|---|
| JP | 10-171399 | 6/1998 |
| KR | 99-69138 | 9/1999 |

* cited by examiner

*Primary Examiner*—Don Wong
*Assistant Examiner*—Jimmy T. Vu
(74) *Attorney, Agent, or Firm*—Fleshner & Kim, LLP

(57) ABSTRACT

A plasma display panel capable of utilizing a radio frequency discharge efficiently and driving method and apparatus thereof are disclosed. In the PDP, each cell is provided with a radio frequency electrode for applying a radio frequency voltage, a data electrode for applying a data voltage, a scanning electrode for applying a scanning voltage, and a discharge space into which discharge gases for causing a gas discharge are injected. Accordingly, a distance between two electrodes used for a radio frequency discharge is assured sufficiently to utilize a smooth radio frequency discharge as a display discharge, thereby improving the brightness and the discharge efficiency. Also, an alternating current discharge having a control easiness is used for the address discharge while a radio frequency discharge having a good efficiency is used for a sustaining discharge, thereby utilizing advantages in the two discharge.

34 Claims, 11 Drawing Sheets

PLASMA DISPLAY PANEL USING RADIO FREQUENCY AND METHOD AND APPARATUS FOR DRIVING THE SAME

BACKGROUND OF THE INVENTION

1. Field of the Invention

This invention relates to a plasma display device, and more particularly to a plasma display panel that is adapted to make use of a radio frequency discharge.

2. Description of the Related Art

Recently, a plasma display panel(PDP) feasible to the fabrication of large-scale panel has been available for a flat panel display device. The PDP controls a discharge interval of each pixel to display a picture. Such a PDP typically includes a PDP of alternating current(AC) system having three electrodes and driven with an AC voltage as shown in FIG. 1.

FIG. 1 shows a cell structure arranged in a matrix pattern in the conventional AC system PDP. The PDP cell includes a sustaining electrode pair 12A and 12B formed on an upper substrate 10 sequentially, an upper plate having an upper dielectric layer 14 and a protective film 16, and a lower plate having an address electrode 20, a lower dielectric layer 22, a barrier rib 24 and a fluorescent layer 26. The upper substrate 10 and the lower substrate 18 are spaced, in parallel, by the barrier rib 24. The sustaining electrode pair 12A and 12B consists of a scanning/sustaining electrode and a sustaining electrode.

A scanning signal for a panel scanning and a sustaining signal for a discharge sustaining are applied to the scanning/sustaining electrode 12A while a sustaining signal is applied to the sustaining electrode 12B. An electric charge is accumulated into the upper dielectric layer 14 and the lower dielectric layer 22. The protective film 16 prevents a damage of the upper dielectric layer 14 due to the sputtering, thereby prolonging a life of PDP as well as improving an emissive efficiency of secondary electrons. Usually, MgO is used as the protective film 16. The address electrode 20 is crossed with the sustaining electrode pair 12A and 12B. A data signal for selecting cells to be displayed is applied to the address electrode 20. The barrier rib 24 is formed in parallel to the address electrode 20. The barrier 24 prevents an ultraviolet ray produced by a discharge from being leaked into the adjacent cell. The fluorescent layer 26 is coated on the surface of the lower dielectric layer 22 and the barrier rib 24 to generate any one of a red, green, and blue visible lights. An inactive gas for a gas discharge is sealed into an inner discharge space.

The PDP cell having the structure as described above sustains a discharge by a surface discharge between the sustaining electrode pair 12A and 12B after being selected by an opposite discharge between the address electrode 20 and the scanning/sustaining electrode 12A. In the PDP cell, the fluorescent body 26 is radiated by an ultraviolet ray generated during the sustaining discharge to emit a visible light into the exterior of the cell. As a result, the PDP having the cells displays a picture. In this case, the PDP controls a discharge-sustaining interval, that is, a sustaining discharge frequency of the cell to implement a gray scale required for an image display. Accordingly, the sustaining discharge frequency becomes an important factor for determining the brightness and a discharge efficiency of the PDP. For the purpose of performing such a sustaining discharge, a sustaining pulse having a duty ratio of 1, a frequency of 200 to 300 kHz and a width of about 10 to 20 $\mu$s is alternately applied to the sustaining electrode pair 12A and 12B. The sustaining discharge is generated only once at an extremely short instant per the sustaining pulse by responding to the sustaining pulse. Charged particles generated by the sustaining discharge are moved along a discharge path formed between the sustaining electrode pair 12A and 12B in accordance with the polarity of the sustaining electrode pair 12A and 12B to form a wall charge on the surface of the upper dielectric layer 14. This wall charge cancels a voltage applied between the sustaining electrode pair 12A and 12B to reduce a discharge voltage loaded in the discharge space, thereby stopping the sustaining discharge. As described above, the sustaining discharge is generated only once at an extremely shorter instant than a width of the sustaining pulse, and it is consumed for a formation step of wall charge and a preparation step of the next sustaining discharge. Due to this, in the conventional PDP, a real discharge interval becomes very short in comparison to the entire discharge interval to have a low brightness and discharge efficiency.

In order to solve such a problem of low brightness and discharge efficiency, we has suggested a method of utilizing a radio frequency discharge using a radio frequency signal of hundreds of MHz as a display discharge. In the case of the radio frequency discharge, electrons perform an oscillating motion by the radio frequency signal to sustain the display discharge during a time interval when the radio frequency signal is applied. More specifically, when a radio frequency signal having a continuously alternating polarity is applied to any one of the two opposed electrodes, electrons within the discharge space are moved toward one electrode or the other electrode depending on the polarity of the voltage signal. In the case where electrons are moved into any one electrode, if the polarity of a radio frequency voltage signal having been applied to the electrode before the electrons arrive at the electrode is changed, then a movement speed of the electrons is decelerated gradually and hence a movement direction thereof is changed. The polarity of the radio frequency voltage signal applied to the electrode before the electrons within the discharge space arrive at the electrode, so that the electrons do an oscillating motion between the two electrodes. Accordingly, when the radio frequency voltage signal is being applied, ionization, an excitation and a transition of gas particles are continuously generated without an extinction of electrons. The display discharge is sustained during most discharge time, so that the brightness and a discharge efficiency of the PDP can be improved. Such a radio frequency discharge has the same physical characteristic as a positive column in a glow discharge structure.

However, the conventional PDP having the cell structure shown in FIG. 1 is unsuitable for making use of the above-mentioned radio frequency discharge. In other words, in order to utilize the radio frequency discharge as the display discharge, a distance between the two electrodes must be assured sufficiently. Since there exists a limit in increasing the size of cell when the scanning/sustaining electrode 12A and the sustaining electrode 12B formed on the same surface is used for the radio frequency discharge, however, a distance between the electrodes required for the radio frequency discharge can not be assured sufficiently by the conventional AC-system PDP structure. Accordingly, it is necessary to provide a PDP having a structure suitable for making use of the radio frequency discharge.

SUMMARY OF THE INVENTION

Accordingly, it is an object of the present invention to provide a plasma display panel that can utilize a radio frequency discharge efficiently.

Further object of the present invention is to provide a PDP driving mechanism and method that can efficiently drive the PDP utilizing a radio frequency.

Still further object of the present invention is to provide a PDP driving apparatus that can efficiently drive the PDP utilizing a radio frequency.

In order to achieve these and other objects of the invention, a radio frequency plasma display panel according to one aspect of the present invention has cells each of which comprises a radio frequency electrode for applying a radio frequency voltage; a data electrode for applying a data voltage; a scanning electrode for applying a scanning voltage; and a discharge space into which discharge gases for causing a gas discharge are injected.

A method of driving a plasma display panel according to another aspect of the present invention includes an addressing step of applying a data voltage to the data electrode and applying a scanning voltage to the scanning electrode sequentially along scanning lines of the panel, thereby selecting display cells by AC discharge between the data electrode and scanning electrode. and a radio frequency sustaining discharge step of applying a radio frequency signal to the radio frequency electrode and applying a reference voltage of the radio frequency signal to the scanning electrode to cause a radio frequency discharge at the selected cell, thereby sustaining a display.

A method of driving a radio frequency signal plasma display panel according to still another aspect of the present invention includes an application step of applying a radio frequency voltage to the radio frequency electrode; an addressing step of applying a voltage to the data electrode and the scanning electrode to cause an AC discharge; a sustaining step of allowing charged particles produced by the address discharge to cause a sustaining radio frequency discharge by the radio frequency voltage; and an erasure step of erasing the radio frequency discharge.

A method of driving a radio frequency signal plasma display panel according to still another aspect of the present invention includes an addressing step of applying a voltage to the data electrode and the scanning electrode to cause an AC discharge; a sustaining step of applying a radio frequency signal to the radio frequency electrode to allow charged particles produced by the address discharge to cause a sustaining radio frequency discharge; and an erasure step of turning off the radio frequency signal to erase the radio frequency discharge.

A driving apparatus for a radio frequency plasma display panel according to still another aspect of the present invention comprises address driving means for driving the scanning electrode lines and address electrode lines; radio frequency driving means for driving radio electrode lines; and low pass filtering means connected among the address driving means, the scanning electrode and the data electrode to shut off a radio frequency signal.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
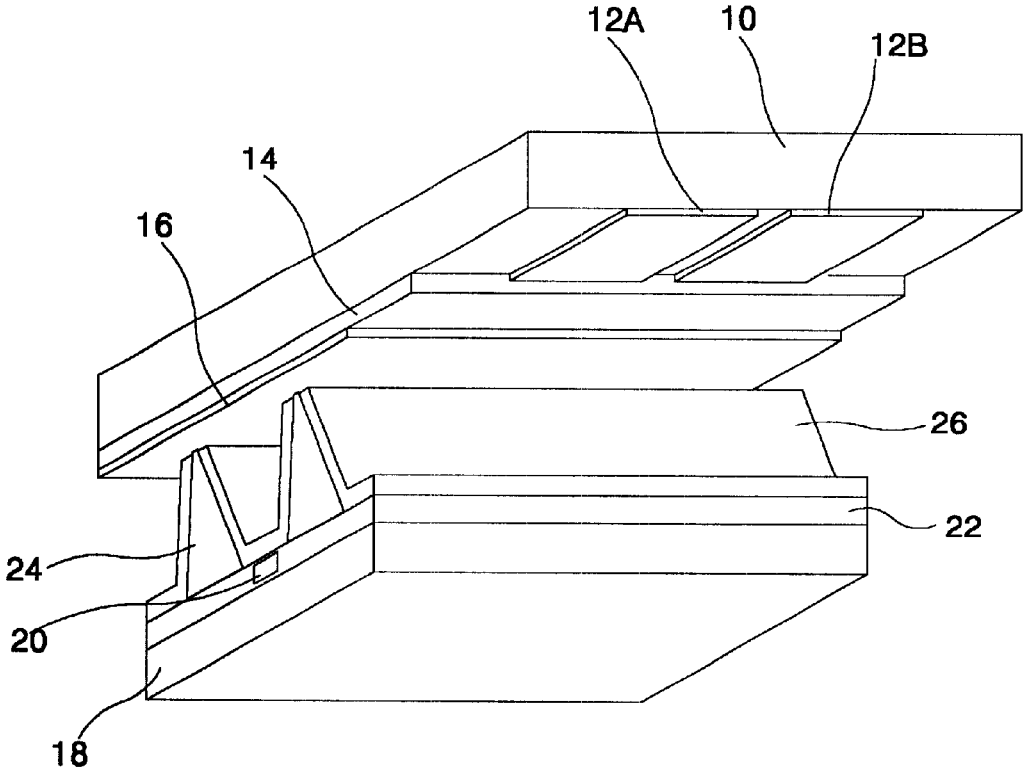
FIG. 1 RELATED ART
FIG. 1 is a perspective view showing the structure of a cell of the conventional three-electrode AC-system PDP.
Figure 2:
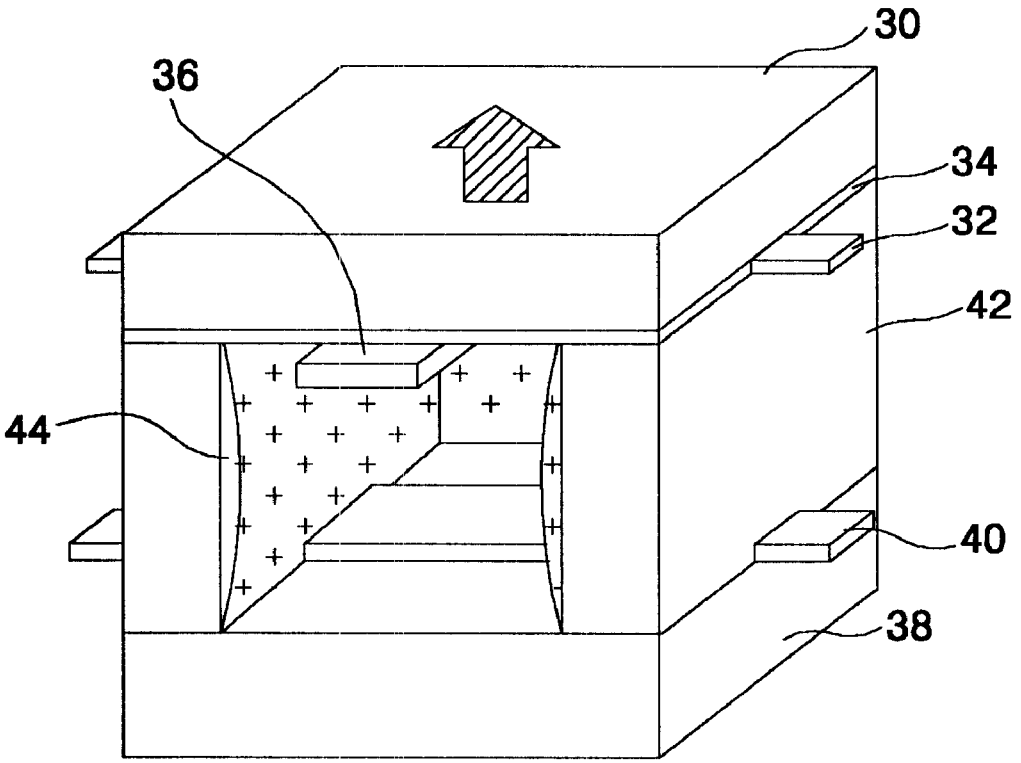
FIG. 2 is a perspective view showing the structure of a radio frequency PDP cell according to an embodiment of the present invention.

Referring to FIG. 2, there is shown a radio frequency PDP cell according to an embodiment of the present invention. The PDP cell includes a data electrode 32 and a scanning electrode 36 that are formed perpendicularly on an upper substrate 30, a radio frequency electrode 40 arranged, in parallel to the data electrode 32, on the data electrode 32, and a barrier rib 42 formed between the upper substrate 26 and the lower substrate 28. The data electrode 32 supplies a data signal for selecting a cell to be displayed. The scanning electrode 36 supplies a scanning signal for a panel scanning and is responsible for a counterpart electrode of the radio frequency electrode 40. The radio frequency electrode 40 provides a radio frequency signal. A dielectric layer 34 for an electric charge accumulation and insulation is formed between the data electrode 32 and the scanning electrode 36. The barrier rib 42 shuts off an optical interference between the cells. In this case, the barrier rib 42 is formed in a structure closed on all sides. In the PDP in FIG. 1, since it is not difficult to isolate the plasma in the cell unit by utilizing a surface discharge caused by a voltage applied between the sustaining electrode pair 12A and 12B formed on one side during the sustaining discharge, the barrier rib 42 with a stripe shape is used. On the other hand, in the PDP according to the present invention, it is difficult to isolate the plasma in the cell unit by utilizing an opposite discharge occurring between the upper and lower plate electrodes 32 and 40 during the radio frequency discharge. Accordingly, the PDP according to the present invention has the barrier rib 42 formed in a lattice structure so as to isolate the discharge space in the cell unit. Also, the barrier rib 42 has a height raised in comparison to the prior art barrier rib for the purpose of performing the radio frequency discharge between the scanning electrode 36 and the radio frequency electrode 40 smoothly. A fluorescent body 44 is coated on the surface of the barrier rib 42 to emit an inherent color of visible light by a vacuum ultraviolet generated during the radio frequency discharge. A discharge gas is filled in a discharge space provided by the upper substrate 30, the lower substrate 38 and the barrier rib 42. Since a positive ion ionized from the discharge gas during the radio frequency discharge has a relatively heavier mass than an electron, it fails to be moved in an instant by a field variation due to a radio frequency signal. Accordingly, the positive ion maintains almost a stationary state within the discharge space, so that an ion impact to the electrode in the prior art does not exist. Therefore, a protective film for protecting the dielectric layer 34 and the scanning electrode 36 is not required, but a protective film (not shown) may be provided on the surface of the dielectric layer 34 so as to improve a generation efficiency of secondary electron.

Figure 3A:
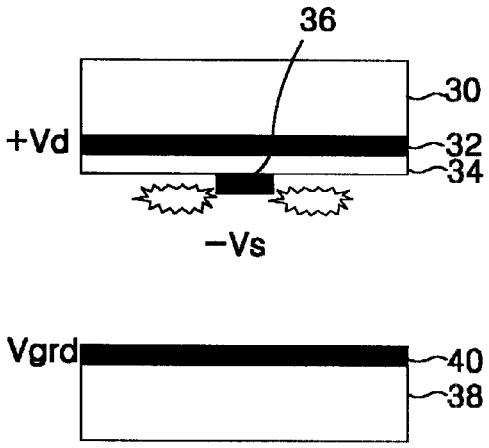
FIGS. 3A to 3C are sectional views for representing a discharge mechanism of the PDP cell shown in FIG. 2 step by step.
Figure 3B:
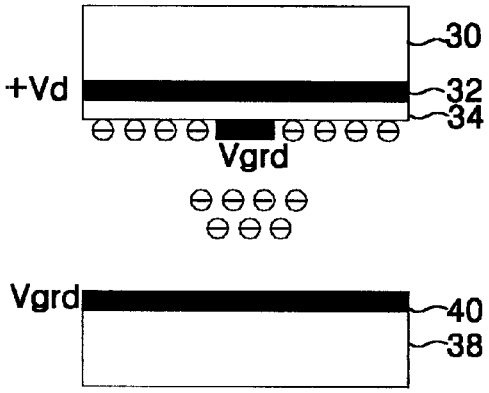
Figure 3C:
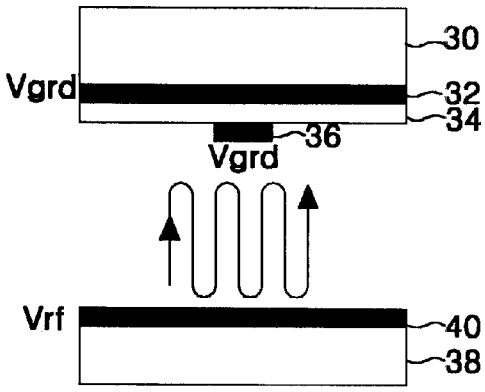

The PDP cell having the structure as described above is driven in accordance with a driving mechanism as shown in FIG. 3A to FIG. 3C. In FIG. 3A, an address discharge is generated by a voltage applied to each of the data electrode 32 and the scanning electrode 36. For instance, if a positive data voltage +Vd is applied to the data electrode 32 while a negative scanning voltage −Vd is applied to the scanning electrode 36, then an address discharge is generated at a discharge space between the data electrode 32 and the scanning electrode 36. By this address discharge, charged particles are produced at the discharge space. A number of electrons in the charged particles produced at the discharge space are piled up on the surface of the dielectric layer 34 on the data electrode 32 as shown in FIG. 3B, a number of positive electric charges are vanished into the scanning electrode 36. When electrons are piled up on the surface of the dielectric layer 34 to form a wall charge, a discharge voltage is attenuated by the wall charge to interrupt a discharge. After the discharge was stopped, charged particles (i.e., electrons and positive charges) exist in the discharge space. Subsequently, charged particles are emitted from the wall charge by a radio frequency voltage Vrf applied to the radio frequency electrode 40. Relatively light electrons in the emitted charged particles and the charged particles existing in the discharge space do an oscillating motion within the discharge space as shown in FIG. 3C in such a state that they do not arrive at the scanning electrode 36 and the radio frequency electrode. The electrons doing the oscillating motion ionize and excite a discharge gas continuously, and the excited atom and molecule is transited into a base state to emit a vacuum ultraviolet, thereby radiating the fluorescent body 44.

Figure 4:
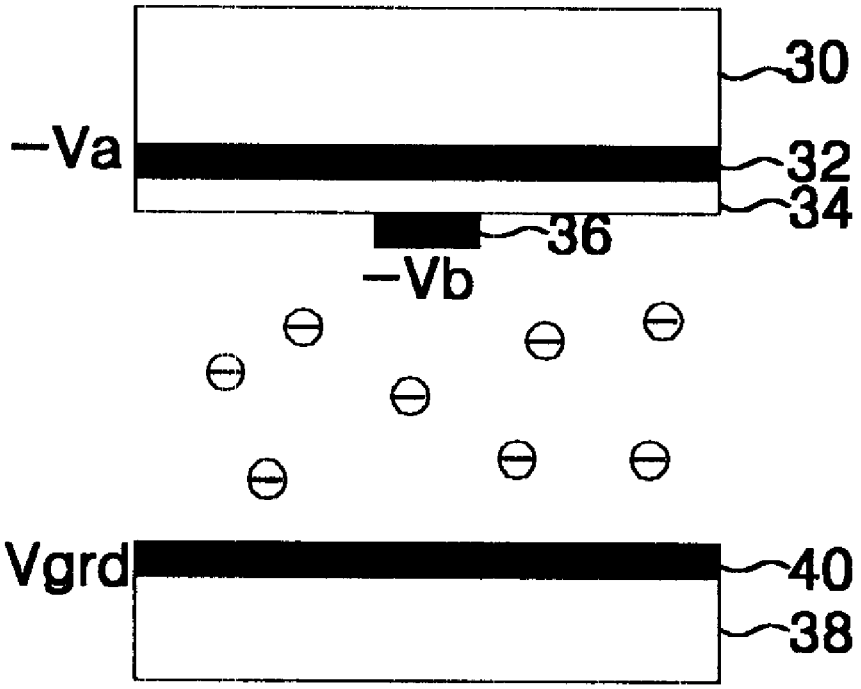
FIG. 4 is a sectional view for representing a discharge mechanism when a triggering voltage is applied to the PDP cell shown in FIG. 3B.

Before the radio frequency discharge caused by the radio frequency voltage Vrf is initiated, a step of activating more electrons in such a manner that more electrons exist in the discharge space as shown in FIG. 4 may be additionally included. For instance, a negative voltage −Va having the same polarity as an electron is applied to the data electrode 32 to emit a lot of electrons having been piled up on the surface of the dielectric layer 34 into the discharge space. At this time, the same polarity of voltage −Vb is applied to the scanning electrode 36 such that the activated electrons are not vanished into the scanning electrode 36. An activation interval requires such a time that electrons can exist sufficiently in the discharge space. Since more electrons can be used for the radio frequency discharge by the triggering step of activating electrons prior to the initiation of radio frequency discharge, the radio frequency voltage can be lowered.

Figure 5:
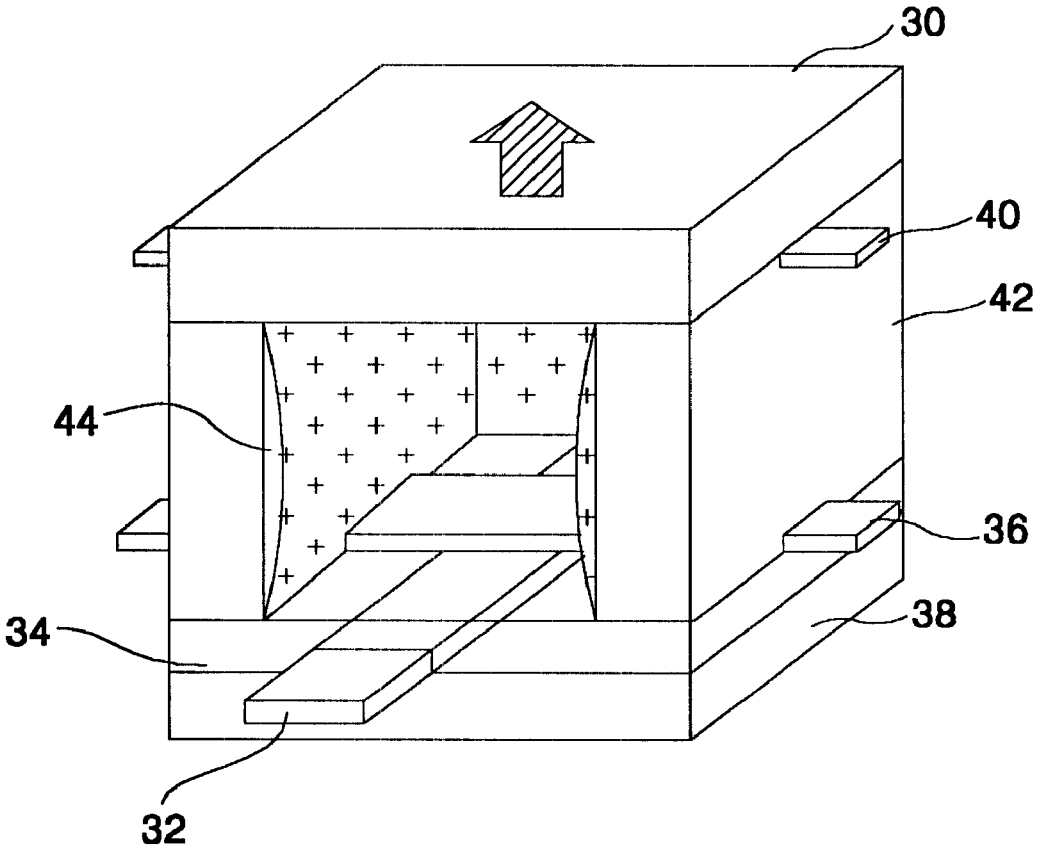
FIG. 5 is a perspective view showing the structure of a radio frequency PDP cell according to an embodiment of the present invention.

Referring to FIG. 5, there is shown a radio frequency PDP cell according to another embodiment of the present invention. The PDP cell includes a radio frequency electrode 40 formed on an upper substrate 30 on the contrary to the PDP cell shown in FIG. 3, and a data electrode and a scanning electrode 36 that are crossed on a lower substrate 38. T he scanning electrode 36 is arranged in parallel to the radio frequency electrode 40. In the PDP cell, an upper plate structure is relatively simplified to increase a transmissive amount of a visible light, thereby improving the brightness of the PDP as a whole.

Figure 6A:
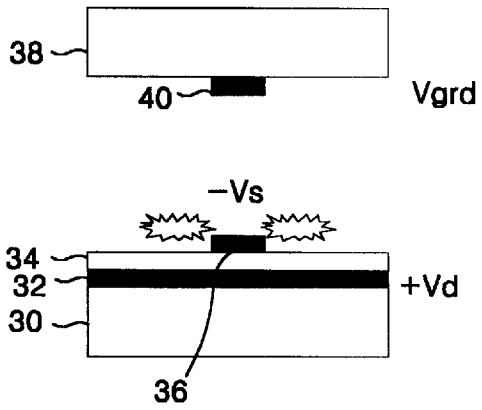
FIGS. 6A to 6C are sectional views for representing a discharge mechanism of the PDP cell shown in FIG. 5 step by step.
Figure 6B:
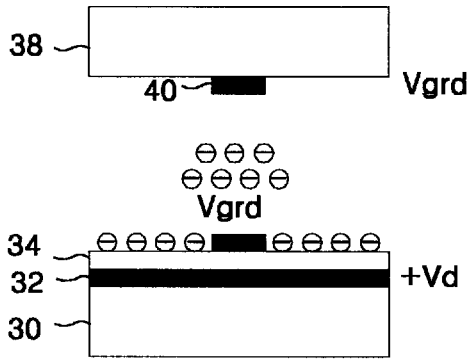
Figure 6C:
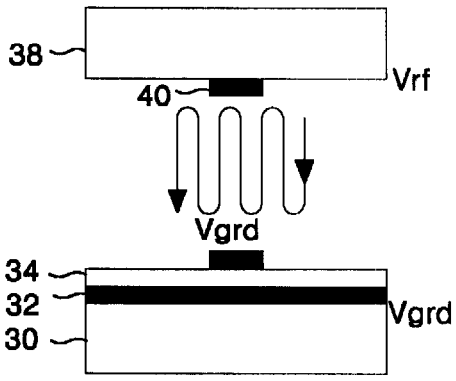

The PDP cell in FIG. 5 is driven in accordance with a driving mechanism as shown in FIG. 6A to FIG. 6C. In FIG. 6A, an address discharge is generated by a voltage applied between the data electrode 32 an d the scanning electrode 36. By this address discharge, charged particles are produced at the discharge space. A number of electrons in the charged particles produced at the discharge space are piled up on the surface of the dielectric layer 34 on the data electrode 32 as shown in FIG. 6B, a number of positive electric charges are vanished into the scanning electrode 36. When electrons are piled up on the surface of the dielectric layer 34 to form a wall charge, a discharge voltage is attenuated by the wall charge to interrupt a discharge. After the discharge was stopped, charged particles (i.e., electrons and positive charges) exist in the discharge space. Subsequently, charged particles are emitted from the wall charge by a radio frequency voltage Vrf applied to the radio frequency electrode 40. Relatively light electrons in the emitted charged particles and the charged particles existing in the discharge space do an oscillating motion within the discharge space as shown in FIG. 6C. The electrons doing the oscillating motion ionize and excite a discharge gas continuously, and the excited atom and molecule is transited into a base state to emit a vacuum ultraviolet, thereby radiating the fluorescent body 44.

As described above, the radio frequency PDP according to the present invention makes use of an alternating current (AC) discharge at the time of address discharge and does a radio frequency discharge only at the time of sustaining discharge which is a display interval. A method of applying a radio frequency signal to the radio frequency PDP cell for the purpose of performing the radio frequency discharge includes the following two schemes. One is to apply a radio frequency signal to the radio frequency electrode 40 continuously irrespectively of the address interval and the sustaining interval. In this case, the radio frequency discharge caused by the radio frequency signal is interrupted by applying an erasing voltage to the data electrode 32 or the scanning electrode 36. The other scheme is to apply a radio frequency signal only in a desired sustaining interval by switching the radio frequency signal applied to the radio frequency electrode directly.

Figure 7:
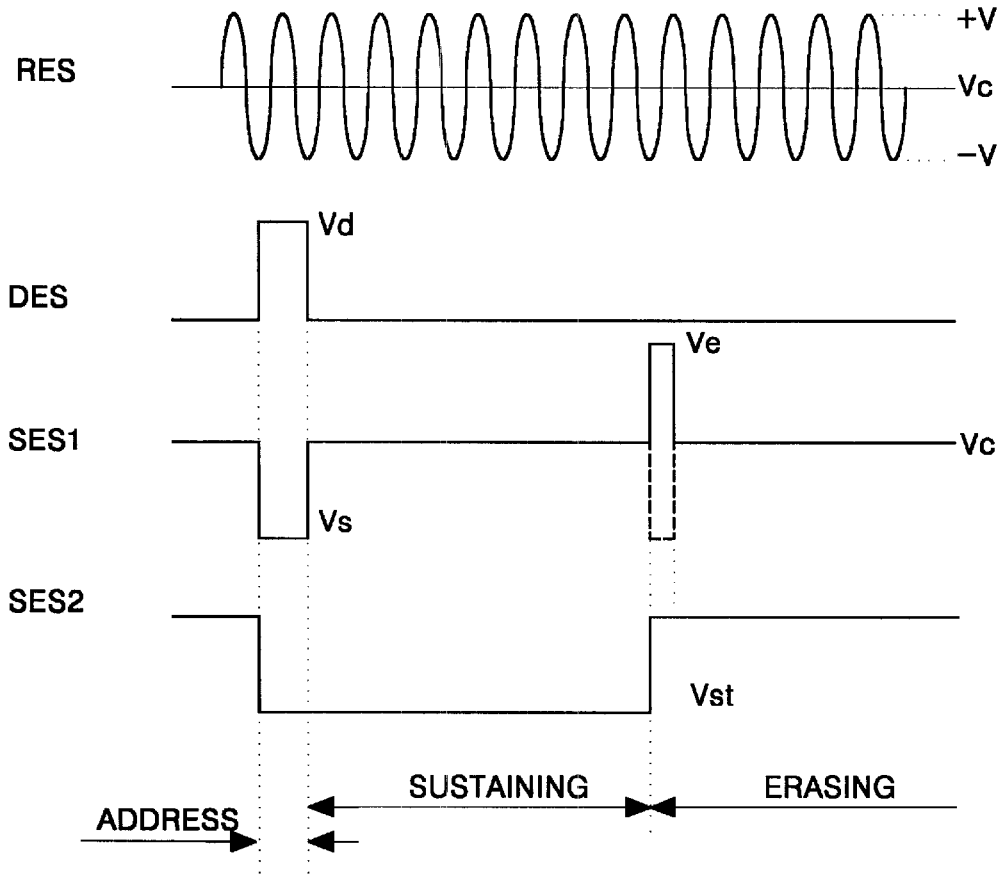
FIG. 7 is waveform diagrams of driving signals applied to each electrode of the PDP cells shown in FIG. 2 and FIG. 5 when a radio frequency signal is not switched.

The former PDP driving method will be described in detail with reference to FIG. 7 and FIG. 8, and the latter PDP driving method will be described in detail with reference to FIG. 9 and FIG. 10. In FIG. 7, a radio frequency signal RES is applied to the radio frequency electrode 40, a data electrode signal DES to the data electrode 32, and a first scanning electrode signal SES1 to the scanning electrode 36. The radio frequency signal RES is continuously applied to the radio frequency electrode 40. A scanning voltage −Vs identical to the first scanning electrode signal SES1 is sequentially applied to the scanning electrode at each scanning line built in the panel. Accordingly, an address discharge is generated by a voltage difference between the scanning voltage −Vs applied to the scanning electrode and a data voltage Vd applied to the data electrode 32. By this address discharge, electric charged particles are produced at the discharge space. Since charged particles has not been produced even though the radio frequency signal RES is continuously applied to the radio frequency electrode 40 before such an address discharge is generated, a discharge does not occur and hence a radiation is not generated. The charged particles produced by the address discharge do an oscillating motion by a radio frequency signal applied to the radio frequency electrode 40 directly to thereby cause a continuous radio frequency discharge during the sustaining interval. In the sustaining interval, a center voltage Vc that is a reference voltage of the radio frequency signal is applied to the scanning electrode 32. Just after an address discharge was generated at the cell as described above, a radio frequency discharge is continuously generated to provide a display luminescence. The radio frequency discharge having been sustained during the sustaining interval is interrupted by a positive (or negative) erasing voltage Ve applied to the scanning electrode 36 or the data electrode 32. Accordingly, if timing applied with the erasing voltage Ve is controlled, a brightness control, that is, a gray scale expression on the cell becomes possible. When such driving waveforms are applied to the entire panel, the address discharge and the radio frequency discharge following the address discharge is generated in a line sequence, and the radio frequency discharge is erased in a line sequence after a desired sustaining interval generating the radio frequency discharge lapsed.

In order to utilize the AC address discharge and the radio frequency sustaining discharge as described above, a driving waveform applied to the scanning electrode 36 in the radio frequency PDP according to the present invention may be changed into various shapes besides the first scanning electrode signal SES1.

Specifically, a sustaining voltage Vst extending from the address interval into the sustaining interval like the second scanning electrode signal SES2 shown in FIG. 7 may be applied to the scanning electrode 36. In other words, the radio frequency signal RES is always applied to the radio frequency electrode 40, and the sustaining voltage Vst is sequentially applied to the scanning electrode 36 every scanning line like the second scanning electrode SES2. The sustaining voltage Vst is within a radio frequency range applied to the radio frequency electrode. By a voltage difference between a data voltage Vd applied to the data electrode 32 and the sustaining voltage Vst applied to the scanning electrode 32, an address discharge is generated at a cell having not generated any discharge even when the radio frequency signal RES is applied. Electric charged particles produced by the address discharge do an oscillating motion within the discharge space by a radio frequency voltage applied the radio frequency electrode 40 and the scanning electrode 36. Accordingly, since the scanning electrode 36 has a voltage beyond a voltage range of the radio frequency signal RES at a time when the sustaining voltage(Vst) pulse is terminated, an oscillating motion of electrons is interrupted and electric charged particles is vanished to thereby stop the radio frequency discharge. Accordingly, if a pulse width of the sustaining voltage Vst applied to the scanning electrode 36 is controlled, a brightness control of the cell becomes possible. When such driving waveforms are applied to the entire panel, the address discharge and the radio frequency discharge following the address discharge is generated in a line sequence, and the radio frequency discharge is erased in a line sequence.

Figure 8:
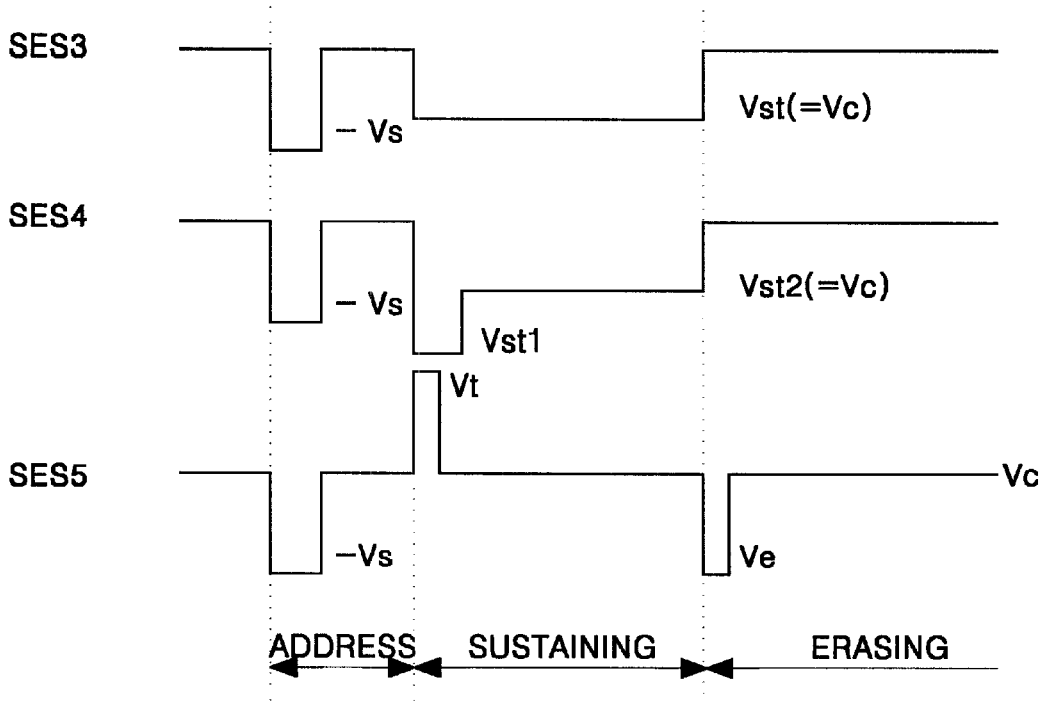
FIG. 8 is waveform diagrams of various signals applied to the scanning electrode in FIG. 7.

Otherwise, when a radio frequency discharge is simultaneously caused at the entire panel after an address discharge was line-sequentially generated at the panel and then a radio frequency discharge is simultaneously erased after a desired time, various type of third to fifth scanning electrode signals SES3, SES4 and SES5 shown in FIG. 8 may be applied to the scanning electrode 36.

When the third scanning electrode signal SES3 is applied to the scanning electrode 36, an address discharge is generated by a voltage difference between a scanning voltage −Vs applied to the scanning electrode 36 and a data voltage Vd applied to the data electrode 32. Electric charged particles are produced at a cell by this address discharge and maintained in the shape of a wall charge and a minute space charge during an addressing interval for selecting other cells. When a sustaining voltage Vst is applied to the scanning electrode 36 after this addressing interval, a radio frequency discharge is initiated by the sustaining voltage Vst and a radio frequency signal applied to the radio frequency electrode 40. This radio frequency discharge is sustained during a time interval when the sustaining voltage Vst is being applied. The radio frequency discharge is interrupted at a time when the sustaining voltage(Vst) pulse is terminated, that is, in an erasing interval when a voltage beyond a voltage range of the radio frequency signal is applied to the scanning electrode 36. Accordingly, if a pulse width of the sustaining voltage Vst applied to the scanning electrode 36 is controlled, a brightness control of the cell becomes possible.

Meanwhile, a two-step sustaining voltage Vst such as the fourth scanning electrode signal SES4 may be applied to the scanning electrode 32. Herein, the first sustaining voltage Vst1 is a voltage for activating more wall charges into space charges and which has a larger absolute value than the second sustaining voltage Vst2 for sustaining the radio frequency discharge. In this case, more electrons are activated by the first sustaining voltage Vst1 to be used for the radio frequency discharge, so that the brightness and a discharge efficiency is improved. Also, a wall charge of each cell non-uniformed due to a time difference at which an address discharge is initiated in the address interval by the first sustaining voltage is compensated to uniform an amount of activated space charges, thereby having an uniformity at the time of radio frequency discharge. Herein, the second sustaining voltage Vst2 becomes equal to a center voltage Vc of the radio frequency voltage.

Alternatively, a signal shape including a triggering voltage pulse Vt and an erasing voltage pulse Ve such as the fifth scanning electrode signal SES5 shown in FIG. 8 may be applied to the scanning electrode 36. In other words, electric charged particles formed during the address discharge are maintained in a shape of wall charge in the addressing interval. If the triggering voltage pulse Vt is applied at a time when the addressing interval is terminated and the sustaining interval is started, a minute discharge is generated to activate the wall charge into a space charge. Electrons in the activated space charge are used for the radio frequency discharge by a radio frequency signal. When the erasing pulse Ve is applied after a desired sustaining interval, the radio frequency discharge is interrupted.

When driving waveforms shown in FIG. 8 are applied to the entire panel, an address discharge is generated in a line sequence, and thereafter a radio frequency discharge is simultaneously initiated at the entire panel and sustained during a desired sustaining interval. At the same time, the radio frequency discharge is erased. Accordingly, a gray scale can be implemented by controlling a time applied with the erasing voltage.

Figure 9:
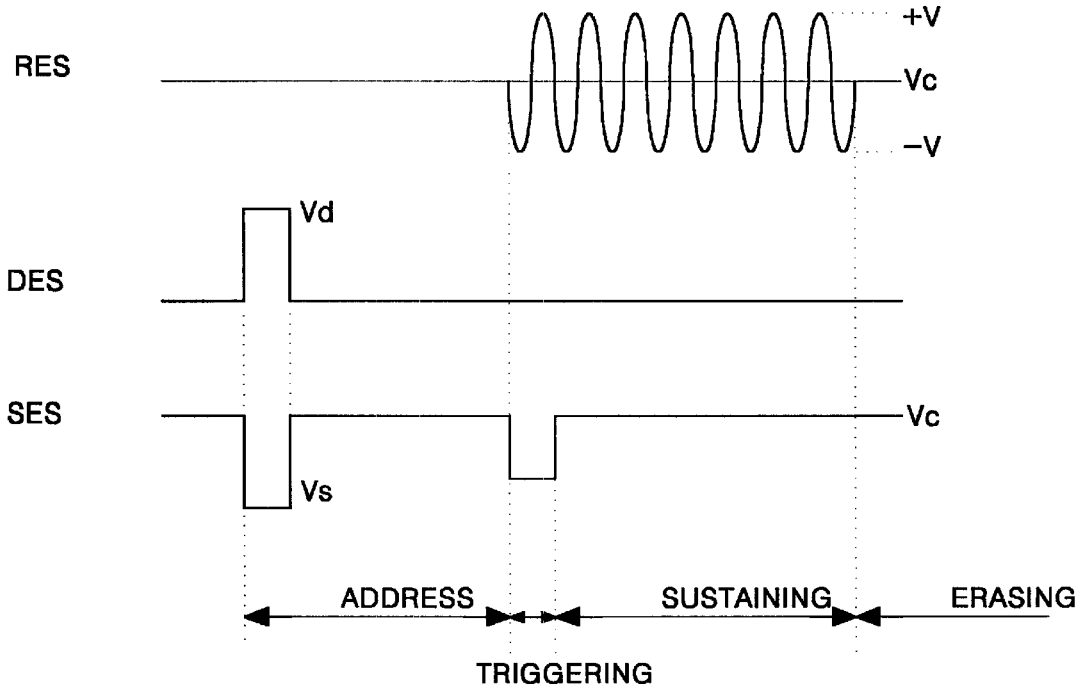
FIG. 9 is waveform diagrams of driving signals applied to each electrode of the PDP cells shown in FIG. 2 and FIG. 5 when a radio frequency signal is switched.

Referring now to FIG. 9, there are shown driving pulses for driving the cell when the radio frequency signal RES is directly switched to apply it only in a desired sustaining interval. If a driving voltage −Vs is applied to the scanning electrode 36 while a data voltage Vd is applied to the data electrode 32, an address discharge is generated by a voltage difference between two electrodes 32 and 36. Electric charged particles produced by the address discharge is maintained in a shape of wall charge during the address interval. If a radio frequency signal is applied to the radio frequency electrode 40 after the termination of the addressing interval, a radio frequency discharge is initiated. In this case, since the charged particles produced by the address discharge are in a shape of wall charge, a triggering step for activating the wall charge into a space charge may be additionally included for the purpose of more stabilizing the radio frequency discharge. In the triggering step, a triggering voltage(Vt) pulse is applied to the scanning electrode 36 to activate the wall charge into the space charge. In this case, when the same polarity of triggering voltage pulse is applied to the data electrode 32, a triggering effect becomes more probable. The activated wall charge is used for the radio frequency discharge by a radio frequency signal. The same effect can be obtained when a magnitude of the radio frequency signal RES is controlled as shown in FIG. 10 instead of applying a triggering voltage pulse to the scanning electrode 36 and the data electrode 32. In other words, a radio frequency signal having a relatively large voltage value is applied in the triggering interval to activate the wall charge into a space charge. Subsequently, a radio frequency signal having a voltage value enough to sustain a discharge by utilizing the activated space charge is applied in the sustaining interval. When such a desired sustaining interval lapses, the radio frequency signal is turned off to interrupt the radio frequency discharge.

Figure 10:
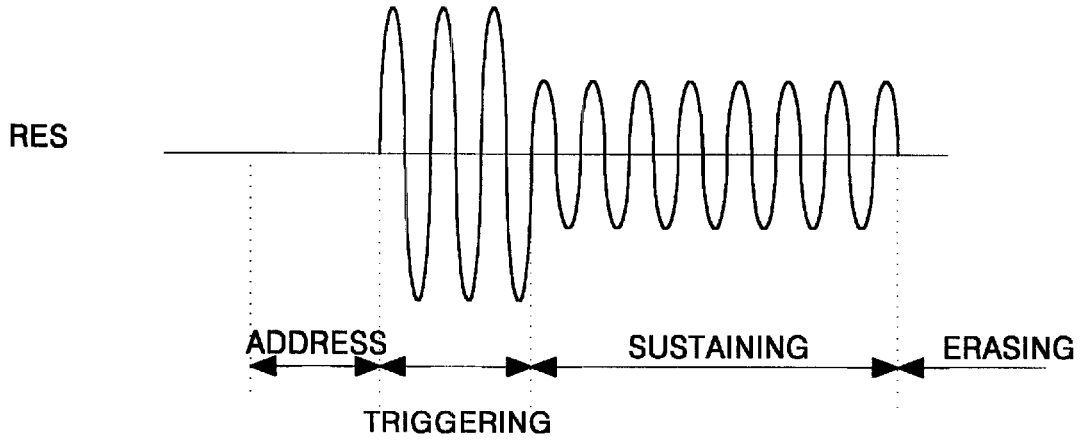
FIG. 10 is waveform diagrams of other signals applied to the scanning electrode in FIG. 9.

When driving waveforms shown in FIG. 9 and FIG. 10 are applied to the entire panel, the radio frequency discharge is simultaneously initiated at the entire panel after the address discharge was generated in a line sequence and sustained during a desired sustaining interval. Accordingly, a gray scale can be implemented by controlling an on/off timing of the radio frequency signal.

Figure 11:
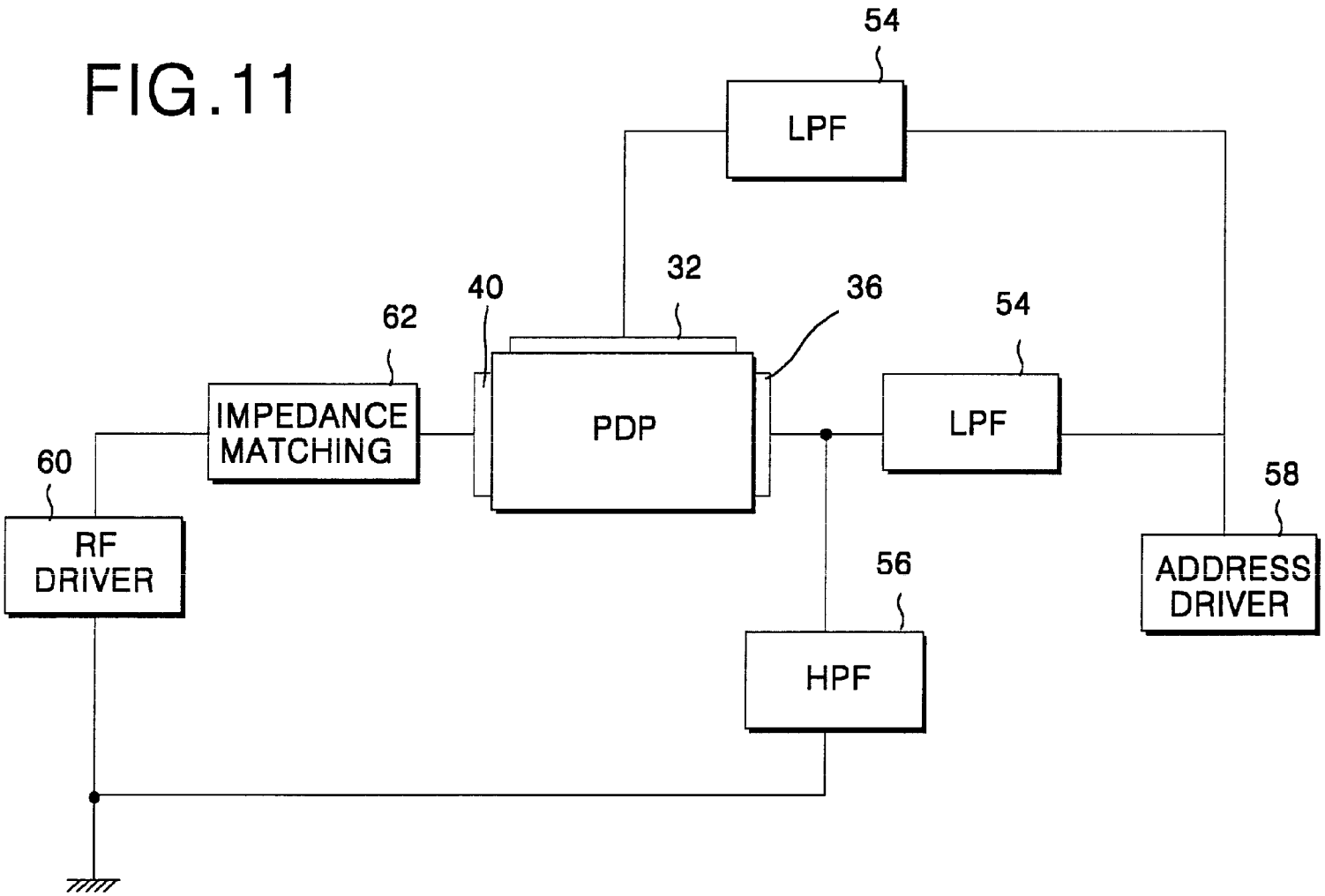
FIG. 11 is a block diagram showing the configuration of a radio frequency driving apparatus according to an embodiment of the present invention.

Referring now to FIG. 11, there is shown a radio frequency PDP driving apparatus according to an embodiment of the present invention. In order to drive the radio frequency PDP of the present invention efficiently as mentioned above, an AC discharge having an easy control characteristic is utilized in the address interval and a radio frequency discharge having a good efficiency characteristic is utilized in the sustaining interval. To this end, an AC voltage is applied to a data electrode 32 and a scanning electrode 36 in the addressing interval and a radio frequency signal is applied to a radio frequency electrode 40. Also, a reference voltage of the radio frequency signal is applied to the scanning electrode 36, which is a counterpart electrode. In this case, since the scanning electrode 36 is used during both the AC discharge and the radio frequency discharge, a problem may be caused in that other AC signals are distorted or a AC driving circuit are damaged. In order to overcome such a problem, as shown in FIG. 11, the radio frequency PDP driving apparatus includes an address driver 58 for driving the scanning electrode 36 and the data electrode 32 in a PDP 52 connected over a low pass filter(LPF) 54, a radio frequency driver 60 connected commonly to the radio frequency electrode 40 in the PDP 52 and, at the same time, connected to the scanning electrode 36 via a high pass filter(HPF) 56 to drive the radio frequency electrode 40, and a data driver for driving the data electrode 32. The low pass filter 54 passes a low frequency of AC driving signal applied to the scanning electrode 36 and the data electrode 32 and shuts off a radio frequency signal derived via the data electrode 32 and the scanning electrode 36. The high pass filter 56 passes a radio frequency signal. The address driver 58 applies a scanning signal to the scanning electrode 36 connected via the low pass filter 54. Also, the address driver 58 applies a data signal to the data electrode 32 connected via the low pass filter 54 to generate a selective address discharge at cells in the PDP 52. At the cell in which the address discharge is generated, a radio frequency discharge is generated by a radio frequency signal applied commonly to the radio frequency electrode 40 connected to the radio frequency driver 60 commonly. In this case, the scanning electrode 36 is connected a ground of the radio frequency driver 60 to serve as a counterpart electrode of the radio frequency electrode 40. The high pass filter 56 passes a radio frequency signal. The low pass filter 54 shuts off the derived radio frequency signal to prevent an influence on the address driver 58. Accordingly, in spite of a fact that an AC circuit and a radio frequency circuit shares the scanning electrode line, the radio frequency circuit becomes an open circuit with respect to the AC circuit(in real, an AC current does not almost flow into the radio frequency circuit) and the AC circuit also becomes an open circuit with respect to the radio frequency circuit. In other words, a filtering circuit is applied to a portion at which a radio frequency signal and an altering current signal are mixed so as to configure two independent radio frequency circuit and alternating current circuit, thereby preventing a distortion of the alternating signal due to a radio frequency interference as well as a damage of an alternating current driving circuit due to a radio frequency interference. As a result, the PDP driving apparatus using the radio frequency signal according to the present invention is capable of implementing a hybrid-type radio frequency PDP which mixes a radio frequency plasma having an excellent efficiency with an alternating current plasma having a control easiness.

As described above, the radio frequency PDP according to the present invention is arranged at the structure having two opposed electrodes used for a radio frequency discharge to assure a sufficient distance between the electrodes, so that it can utilize a smooth radio frequency discharge as a display discharge to improve the brightness and a discharge efficiency. The radio frequency PDP driving method according to the present invention employs an alternating current plasma having a control easiness during an address discharge while it employs a radio frequency plasma having a good efficiency during the display discharge, thereby driving the radio frequency PDP. Particularly, more electrons is used for a radio frequency discharge when a triggering voltage is applied prior to an initiation of radio frequency discharge, thereby lowering a radio frequency voltage as well as improving the brightness and a discharge efficiency. In the radio frequency PDP driving apparatus according to the present invention, a filtering circuit is applied to a portion at which a radio frequency signal is mixed with an alternating current signal so as to configure two independent radio frequency circuit and alternating current driving circuit, thereby preventing a distortion of the alternating current signal due to a radio frequency interference as well as a damage of the AC driving circuit. Accordingly, it is capable of implementing a hybrid-type radio frequency PDP that mixes a radio frequency plasma having an excellent efficiency with an alternating current plasma having a control easiness.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention.

Accordingly, the scope of the invention shall be determined only by the appended claims and their equivalents.

What is claimed is:

1. A radio frequency plasma display panel having cells arranged in a matrix pattern, each of said cells comprising:

a radio frequency electrode which applies a radio frequency voltage;

a data electrode which applies a data voltage;

a scanning electrode which applies a scanning voltage; and a discharge space into which a discharge gas is located for causing a gas discharge, wherein the data electrode and the scanning electrode are located on a same side of the discharge space and the radio frequency electrode is located on an opposing side of the discharge space.

2. A radio frequency plasma display panel having cells arranged in a matrix pattern, each of said cells comprising:

a radio frequency electrode which applies a radio frequency voltage;

a data electrode which applies a data voltage;

a scanning electrode which applies a scanning voltage; and a discharge space into which a discharge gas is located for causing a gas discharge, wherein said discharge space comprises:

a first substrate provided with the radio frequency electrode;

a second substrate provided with the data electrode and the scanning electrode; and a barrier rib provided between the first and second substrates.

3. The plasma display panel as claimed in claim 2, further comprising:

a protective film formed on a dielectric layer provided with the scanning electrode.

4. The plasma display panel as claimed in claim 2, further comprising:

a fluorescent layer formed on a surface of the barrier rib.

5. The plasma display panel as claimed in claim 2, wherein the barrier rib has a structure closed at all sides.

6. A radio frequency plasma display panel having cells arranged in a matrix pattern, each of said cells comprising:

a radio frequency electrode which applies a radio frequency voltage;

a data electrode which applies a data voltage;

a scanning electrode which applies a scanning voltage; and a discharge space into which a discharge gas is located for causing a gas discharge, wherein the radio frequency electrode and the scanning electrode are formed in parallel, and the scanning electrode and the data electrode are formed perpendicularly.

7. A radio frequency plasma display panel having cells arranged in a matrix pattern, each of said cells comprising:

a radio frequency electrode which applies a radio frequency voltage;

a data electrode which applies a data voltage;

a scanning electrode which applies a scanning voltage; and a discharge space into which a discharge gas is located for causing a gas discharge, wherein the radio frequency electrode and the data electrode are formed in parallel, and the data electrode and the scanning electrode are formed perpendicularly.

8. A method of driving a plamsa display panel having a radio frequency electrode, a data electrode and a scanning electrode, comprising:

applying a data voltage to the data electrode and a scanning voltage to the scanning electrode sequentially along scanning lines of the panel to thereby select at least one display cell, said data voltage and said scanning voltage being applied during an addressing interval; and applying a radio frequency signal to the radio frequency electrode and a reference voltage of the radio frequency signal to the scanning electrode during a sustaining interval to cause a radio frequency discharge at the selected cell.

9. The method as claimed in claim 8, further comprising the step of:

applying a triggering voltage to any one of the scanning electrode and the data electrode to activate charged particles formed in a shape of wall charge by the alternating current discharge after said address step.

10. A method of driving a radio frequency signal plasma display panel having a radio frequency electrode, a data electrode and a scanning electrode, comprising:

applying a radio frequency voltage to the radio frequency electrode;

applying a voltage to the data electrode and the scanning electrode to cause an address charge;

allowing charged particles produced by the address charge to cause a sustaining radio frequency discharge by the radio frequency voltage; and an erasure step of erasing the radio frequency discharge.

11. The method as claimed in claim 10, wherein said step of causing an address charge includes:

allowing charged particles produced by the address discharge to be sustained in a shape of a wall charge during a desired time interval.

12. The method as claimed in claim 11, wherein said step of causing a radio frequency discharge includes:

applying a triggering voltage to activate the wall charge.

13. The method as claimed in claim 12, wherein said triggering voltage is applied to the scanning electrode or both the scanning electrode and the data electrode.

14. The method as claimed in claim 10, wherein said step of causing a radio frequency discharge includes applying a center voltage of the radio frequency voltage to the scanning electrode.

15. The method as claimed in claim 10, wherein said erasure step includes applying an erasing voltage pulse to the scanning electrode.

16. The method as claimed in claim 15, wherein said erasure step includes applying a voltage beyond a range of the radio frequency voltage.

17. A method of driving a radio frequency signal plasma display panel having a radio frequency electrode, a data electrode and a scanning electrode, comprising:

applying a voltage to the data electrode and the scanning electrode to cause an address discharge;

applying a radio frequency signal to the radio frequency electrode to allow charged particles produced by the address discharge to cause a sustaining radio frequency discharge; and turning off the radio frequency signal to erase the radio frequency discharge.

18. The method as claimed in claim 17, wherein said step of causing a sustaining radio frequency discharge includes applying a triggering voltage to activate charged particles sustained in a shape of a wall charge.

19. The method as claimed in claim 18, wherein said triggering voltage is applied to the scanning electrode or both the scanning electrode and the data electrode.

20. The method as claimed in claim 17, wherein said step of causing a sustaining radio frequency discharge includes applying a center voltage of the radio frequency voltage to the scanning electrode.

21. A driving apparatus for a radio frequency plasma display panel having cells, each of which includes a radio frequency electrode, a scanning electrode and a data electrode arranged in a matrix pattern, comprising:

address driving means for driving the scanning electrode lines and address electrode lines;

radio frequency driving means for driving radio electrode lines; and low pass filtering means connected among the address driving means, the scanning electrode and the data electrode to shut off a radio frequency signal.

22. The driving apparatus as claimed in claim 21, further comprising:

impedance-matching means connected between the radio driving means and the radio frequency electrode to make an impedance matching of them.

23. The plasma display panel as claimed in claim 1, wherein the radio frequency electrode and the scanning electrode are formed in parallel, and the scanning electrode and the data electrode are formed perpendicularly.

24. The plasma display panel as claimed in claim 1, wherein the radio frequency electrode and the data electrode are formed in parallel, and the data electrode and the scanning electrode are formed perpendicularly.

25. The plasma display panel as claimed in claim 1, further comprising:

a dielectric layer provided with the scanning electrode; and a protective film on the dielectric layer.

26. The plasma display panel as claimed in claim 1, further comprising:

a fluorescent layer on a surface of the barrier rib.

27. The plasma display panel as claimed in claim 1, further comprising:

a barrier rib which separates the radio frequency electrode from the data electrode and the scanning electrode.

28. The plasma display panel as claimed in claim 27, wherein the barrier rib has a structure closed at all sides.

29. The plasma display device as claimed in claim 1, wherein the data electrode crosses the scanning electrode.

30. The plasma display device as claimed in claim 1, wherein the radio frequency electrode is parallel with the scanning electrode and is angularly disposed relative to the data electrode.

31. A method for driving a plasma display panel having a plurality of cells, each of said cells including a radio frequency electrode, a scanning electrode, and a data electrode, said scanning electrode and data electrode being located on a first side of a discharge space and said radio frequency electrode being located on an opposing second side of the discharge space, said method comprising:

applying voltages to said scanning electrode and said data electrode to generate a wall charge on the first side of the discharge space; and applying a radio frequency signal to said radio frequency electrode to convert said wall charge to an oscillating space charge in the discharge space.

32. The method of claim 31, wherein the voltage applied to the data electrode is a positive voltage and the voltage applied to the scanning electrode is a negative voltage.

33. The method of claim 31, wherein the voltages applied to the scanning electrode and the data electrode are both negative voltages.

34. The method of claim 31, further comprising:

varying a waveform of the voltage input into the scanning electrode to vary the oscillating space charge in the discharge space.

* * * * *